United States Patent [19]

Brooks

[11] 3,961,967

[45] June 8, 1976

[54] FOUNDRY FACING SAND COMPOSITION

[75] Inventor: Thomas Aaron Brooks, Moline, Ill.

[73] Assignee: Deere & Company, Moline, Ill.

[22] Filed: Apr. 10, 1974

[21] Appl. No.: 459,782

[52] U.S. Cl. ..... 106/38.23; 106/38.24; 106/38.5 R; 106/37; 164/33; 427/134

[51] Int. Cl.[2] ..... B28B 7/36

[58] Field of Search ..... 106/38.4, 38.5 R, 38.7, 106/38.23, 38.24; 427/134; 164/33

[56] References Cited

UNITED STATES PATENTS

| | | | |
|---|---|---|---|
| 2,507,082 | 5/1950 | Allison | 106/38.4 |
| 2,687,966 | 8/1954 | Miner et al. | 106/38.7 |
| 2,828,214 | 3/1958 | Myers et al. | 106/38.4 |
| 3,027,265 | 3/1962 | Miericke | 106/38.7 |
| 3,535,131 | 10/1970 | Meier | 106/38.5 R |
| 3,723,368 | 3/1973 | Brown et al. | 260/DIG. 40 |

*Primary Examiner*—Lorenzo B. Hayes

[57] ABSTRACT

An improved foundry facing sand is disclosed. The foundry facing sand comprises silica sand admixed therewith, in percent by weight of the silica sand, from about 0.8 to about 2 percent of a cellulose binder, from about 2 to about 6 percent of foundry clay, from about 3.5 to about 7 percent water, from about 1 to about 2.2 percent core oil, from about 0.3 to about 0.5 percent of a release agent-lubricant, and from about 0 to about 20 percent silica flour. The use of such foundry facing sand in green sand molds improves the quality and finish of finished castings and also does not detrimentally affect the permeability of system sand.

8 Claims, No Drawings

FOUNDRY FACING SAND COMPOSITION

BACKGROUND OF THE INVENTION

The use of green sand molds in foundry casting is well known. While green sand molds are relatively inexpensive to use (as compared with dry sand molds), their moisture content creates other problems which limit their usefulness, particularly in the casting of relatively intricate designs. For example, contact of molten metal with the green sand mold surface can vaporize the water and other organic materials to volatiles (steam, carbon oxides and the like). The steam can cause the mold to expand and the escaping volatiles can disrupt the mold surface such that the sand "burns in" the casting. These disruptions detrimentally affect the dimensional quality of the casting so as to preclude the commercial utilization of green sand molds for intricate designs.

It has therefore been proposed to utilize a facing sand composition which is used to form the molten metal-containing sand surface. The facing sand composition generally contains a major amount of sand substantially finer in particle size than the regular (system) sand. For example, system sand generally has a particle size of about 65 to 100 GFN (Grain Fineness Number as determined by the standards of the American Foundrymen's Society) while the sand used in a facing sand composition typically has a particle size of about 225 to about 250 GFN. In addition, the typical facing sand composition contains fine particles of a clay material along with cereal and/or other binders. In many areas of the country, there exists large deposits of bank sand which comprises a mixture of fine particles of sand and clay.

While the use of such facing sand compositions has improved the applicability of green sand molds to casting of intricate designs, problems remain. The reject rate of finished castings due to sand defects remains high. Casting surfaces are often pitted and dirty. In addition, many facing sand compositions have components which produce smoke which present health and/or safety hazards. Facing sand compositions are typically stable only for relatively short periods of time (e.g., about 1 day or less) and are often only moderately (or less) compatible with the system sand forming the bulk of the green sand mold.

The use of facing sand has also created a permeability problem in system sand. In commercial foundries, the sand used for a casting is recovered and recycled for later use in the production of other castings. The inclusion of facing sand (which includes fine sand and clay particles) in a mold thus results in the ultimate inclusion (by recycle) of facing sand in the system sand. Since the fine sand and clay particles of facing sand are inherently less permeable in a mold than the larger-sized sand particles of the system sand, the permeability of the system sand is eventually substantially reduced. The decreased permeability of the system sand results in increased problems in the use of such sand for large castings (e.g., about 8 pounds or more) which generate relatively large amounts of volatiles. For example, the decreased permeability can result in mold wall movement, swells and thermal cracking, any or all of which can result in unacceptable castings. Generally, these large castings do not utilize facing sand per se.

SUMMARY OF THE INVENTION

It is an object of this invention to provide a foundry facing sand composition which avoids or alleviates the problems of the prior art.

It is a specific object of this invention to provide a foundry facing sand composition compatible with system sand and which provides a high level of acceptable castings with a concommitant reduction in unacceptable castings due to sand defects, a green sand mold incorporating such a foundry facing sand composition and a method of casting utilizing such a green sand mold.

In one aspect of the present invention, there is provided a foundry facing sand composition comprising silica sand and admixed therewith, in percent by weight of the silica sand, from about 0.8 to about 2 percent of a cellulose binder, from about 2 to about 6 percent of a foundry clay, from about 3.5 to about 7 percent water, from about 1 to about 2.2 percent core oil, from about 0.3 to about 0.5 percent of a release agent-lubricant and from about 0 to about 20 percent of silica flour.

In another aspect of the present invention, there is provided a green sand foundry mold including as the metal-contacting mold surface, the above-defined facing sand composition.

In still another aspect of the present invention, there is provided a metal casting method which comprises introducing molten metal in the above-defined mold and allowing the metal to cool.

DESCRIPTION OF THE PREFERRED EMBODIMENT

The foundry facing sand composition of the present invention comprises silica sand and admixed therewith, in percent by weight of the silica sand, from about 0.8 to about 2, preferably from about 1.1 to about 1.6, percent of a cellulose binder, from about 2 to about 6, preferably from about 3 to about 5, percent foundry clay, from about 3.5 to about 7, preferably from about 4.7 to about 6, percent water, from about 1 to about 2.2, preferably from about 1.4 to about 2, percent core oil, from about 0.3 to about 0.5 percent release agent-lubricant and from about 0 to about 20, preferably from about 8 to about 12, percent silica flour.

The silica sand which forms the major portion of the foundry facing sand composition of the present invention advantageously is foundry system sand. Suitable foundry sands are well known to those skilled in the art. Quartz sand of varying particle size, e.g., from about 40 to about 175, generally from about 65 to about 100, GFN is typically used. Olivine sand and zircon sand are also suitable.

The cellulose binder can be a conventional cellulose binder such as corn flour, wood flour, wheat hulls or other similar cellulose binder. Corn flour is preferred.

Foundry clays are also well known in the art. Conventional montmorillonite and kaolinite foundry clays are useful in the present invention. Southern bentonite, Western bentonite and fireclay are preferred.

A number of suitable core oils are commercially available and include, for example, unsaturated polymerized oils such as linseed oil, china-wood oil, soybean oil and the like, oil compositions including a heat-treated rosin and the like.

The release agent-lubricant can be any suitable material which will provide both functions in molding. Kerosene, fuel oil, gasoline and silicone-based materials have been found suitable. Graphite has been found to be unsuitable. Kerosene is preferred.

Silica flour is also a conventional foundry material and is comprised of very finely divided silica sand particles. Silica flour typically has a particle size about that of talcum powder. Although the upper limit of silica flour in the foundry facing sand composition of the present invention is generally about 20 percent by weight of the silica sand, more silica sand can be used in some instances to prepare an even finer finish on the casting.

The foundry facing sand composition of the present invention may be mixed in any suitable manner which results in a homogeneous mixture. Advantageously, the silica sand, cellulose binder, silica flour and foundry clay may be mixed in a batch or core sand molder until homogeneous, e.g., about 1 minute. The water is added and the materials mixed until the sand balls up (generally about 1 minute). The core oil and release agent-lubricant may thereafter be added and the entire mixture mixed until homogeneous and fluffy (e.g., about 5 minutes).

The foundry facing sand composition of the present invention may be utilized in a conventional manner with advantageous results. Typically, a pattern is inserted into a flask and the facing composition is then sifted through a riddle onto the surface of the pattern so that it is entirely covered, e.g., to an average depth of approximately one-fourth to one-half of an inch. The depth of the facing composition may vary in accordance with the size of the casting, but should be adequate for a suitable facing of the finished mold.

After the facing composition has been sifted to cover the pattern surfaces, ordinary system sand affording a backing of a high porosity or permeability is deposited on top of the facing composition to fill the flask. The porous backing permits escape of gases upon pouring of molten metal into the finished mold.

The facing composition and the backing sand in the flask are then compacted by any conventional means such as with a jolt-squeeze machine well known in the art and used in most foundries. When the pattern is removed, a mold results which is a firm, accurate impression of the pattern and which comprises a thin facing sand layer as the metal-contacting mold surface integrally united and backed with porous system sand.

Castings, particularly gray iron, aluminum and brass castings, produced with molds of the present invention are dimensionally accurate reproductions of the pattern with extremely fine and clean surface finish.

The invention is additionally illustrated in connection with the following Examples which are to be considered as illustrative of the present invention. It should be understood, however, that the invention is not limited to the specific details of the Examples.

EXAMPLE I

A foundry facing sand composition is prepared from the following components:

| Component | Amount, % by weight of Silica sand |
|---|---|
| Silica sand (70 GFN) | — |
| Corn flour | 1.4 |
| Southern Bentonite | 4 |
| Water | 5.8 |
| Core Oil (vegetable base) | 1.8 |
| Kerosene | 0.4 |
| Silica flour | 10.0 |

The silica sand, corn flour, Southern bentonite and silica flour are first mixed together in a Simpson oil-sand core muller for about 1 minute. The water is thereafter added and the resulting materials mixed until balls are formed (after about 1 minute mixing time). The core oil and kerosene are thereafter added and the resulting mixture mixed for about 5 minutes.

The mixed foundry facing sand composition is riddled onto a pattern surface to provide an average depth of coverage of the pattern of about one-fourth to one-half inch. The balance of the flask containing the pattern is filled with system sand (silica sand 70 GFN) and the flask is jolt-squeezed to provide a conventional foundry mold half. The other mold half is formed in the same manner.

A standard AFS (American Foundrymen's Society) 2 × 2 specimen formed from the facing sand composition of the present invention has a density of 170 gms, a mold hardness of 70 and a green compressive strength of 3.5 psi.

The mold as prepared above is used in the production of castings of intricate design from gray iron, cast at a temperature of about 2600°–2650°F. The finished casting has a smooth, fine finish and a tensile strength of about 30,000 psi.

EXAMPLES II–XIII

Example 1 is repeated using different materials and amounts. The foundry facing sand compositions, density, mold hardness and green compressive strength are shown below in the Table.

TABLE

Foundry Facing Sand Composition
% By Weight of Silica Sand

| Example | Silica Sand 70 GFN | Cellulose Binder | Foundry Clay | | Water | Core Oil | | Release Agent-Lubricant | | Silica Flour |
|---|---|---|---|---|---|---|---|---|---|---|
| II | — | Corn Flour 1.1 | Southern Bentonite | 2.0 | 4.7 | (Vegetable Base) | 1.4 | Kerosene | 0.3 | 8.0 |
| III | — | Corn Flour 1.1 | | 6.0 | 4.7 | (Vegetable Base) | 1.4 | Kerosene | 0.3 | 8.0 |
| IV | — | Corn Flour 1.1 | Western Bentonite | 3.2 | 4.7 | (Vegetable Base) | 1.4 | Kerosene | 0.3 | 8.0 |
| V | — | Corn Flour 1.1 | Southern Bentonite | 3.2 | 6.0 | (Vegetable Base) | 1.4 | Kerosene | 0.3 | 8.0 |
| VI | — | Corn Flour 1.1 | | 3.2 | 4.7 | (Vegetable Base) | 1.0 | Kerosene | 0.3 | 8.0 |
| VII | — | Corn Flour 1.1 | | 3.2 | 4.7 | (Vegetable Base) | 2.0 | | | |
| VIII | — | Corn Flour 1.1 | | 3.2 | 4.7 | (Vegetable Base) | 1.4 | Silicone Mold Lubricant | 0.3 | 8.0 |

TABLE-continued

| Foundry Facing Sand Composition % By Weight of Silica Sand | | | | | | | | | |
|---|---|---|---|---|---|---|---|---|---|
| Example | Silica Sand 70 GFN | Cellulose Binder | Foundry Clay | | Water | Core Oil | | Release Agent-Lubricant | | Silica Flour |
| IX | — | Corn Flour 1.1 | | 3.2 | 4.7 | (Vegetable Base) | 1.4 | Kerosene | 0.3 | 0 |
| X | — | Corn Flour 1.1 | Fire-clay | 3.2 | 4.7 | (Vegetable Base) | 1.4 | Kerosene | 0.3 | 8.0 |
| XI | — | Wood Flour | Southern Bentonite | 3.2 | 4.7 | (Vegetable Base) | 1.4 | Kerosene | 0.3 | 8.0 |
| XII | — | Corn Flour 1.1 | | 3.2 | 4.7 | (Petroleum Base) | 1.4 | Kerosene | 0.3 | 8.0 |
| XIII | — | Corn Flour 1.1 | | 3.2 | 4.7 | (Vegetable Base) | 1.4 | Kerosene | 0.3 | 8.0 |

TABLE

| AFS 2 × 2 Specimen Properties | | | |
|---|---|---|---|
| Example | Density gms | Hardness | Green Compression Strength, psi |
| II | 170 | 64 | 2.7 |
| III | 170 | 75 | 4.7 |
| IV | 168 | 70 | 4.6 |
| V | 173 | 62 | 3.8 |
| VI | 170 | 62 | 3.5 |
| VII | 170 | 65 | 3.4 |
| VIII | 169 | 68 | 2.5 |
| IX | 169 | 69 | 2.8 |
| X | 166 | 76 | 5.2 |
| XI | 169 | 60 | 2.7 |
| XII | 169 | 62 | 3.6 |
| XIII | 170 | 69 | 3.4 |

EXAMPLES XIV, XV

A mold is formed in accordance with Example I and is used for the formation of intricately designed finished castings from molten aluminum (Example XIV) and brass (Example XV). The finished aluminum and brass castings are each of excellent finish quality.

COMPARATIVE EXAMPLE

A facing sand composition is prepared by first mixing a slurry of water (about 82 percent by weight of the slurry), Western bentonite (about 8 percent by weight of the slurry), Southern bentonite (about 1 percent by weight of the slurry), a commercial combustible product mixture (containing cellulose and asphalt derivatives) available as "Green Shell Carb" from the American Colloid Co. (about 3 percent by weight of the slurry) and a finely divided (262 GFN average size) bank sand (about 6 percent by weight of the slurry) which contains about 25 percent fine (through U.S. Sieve 270) silt, clay and sand particles.

This slurry is mix with system sand (70 GFN) in an amount of about 2.8 percent by weight of the system sand. The combustible product mixture ("Green Shell Carb") is also added to this mixture in an amount of about 5 percent by weight of the system sand. This facing sand composition is typical of facing sands used in many commercial foundries.

A batch of this typical facing sand composition is utilized in a commercial foundry operation for the production of a relatively intricate, low dimensional tolerance gray iron casting. A similar-sized batch of facing sand composition of Example I is used to produce the same part in the same manner.

The typical batch dries out in about 24 hours and a new batch must be prepared each day for that day's utilization. The foundry facing sand composition of Example I may be used at least 48 and often 96 hours after preparation without drying out. Over an extended period of use, the scrap rate (due to facing sand defects) for the typical facing sand composition is 40 percent while the scrap rate for the facing sand composition of Example I is less than 5 percent. Also, the permeability of the system sand including the recycled shake-out above-defined typical facing sand is demonstrably less than the permeability of the system sand including the recycled shake-out facing sand of Example I.

Visual observations made during the runs demonstrate that less smoke is emitted from the molds including the facing sand composition of Example I. Also, the finished castings produced with the facing sand composition of the present invention are consistently cleaner appearing.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. A foundry facing green sand mold composition consisting essentially of silica sand and admixed therewith, in percent by weight of the silica sand, from about 0.8 to about 2 percent of a cellulose binder, from about 2 to about 6 percent of foundry clay, from about 3.5 to about 7 percent water, from about 1 to about 2.2 percent core oil, from about 0.3 to about 0.5 percent of a release agent-lubricant selected from the group consisting of kerosene, fuel oil, gasoline, and silicone base materials, and from about 0 to about 20 percent silica flour.

2. The foundry facing green sand composition of claim 1 wherein said cellulose binder is corn flour, wood flour or wheat hulls.

3. The foundry facing green sand composition of claim 1 wherein said foundry clay is bentonite or fireclay.

4. The foundry facing green sand composition of claim 1 wherein said release agent is kerosene.

5. The foundry facing green sand composition of claim 1 wherein said cellulose binder is present in an amount of from about 1.1 to about 1.6 percent by weight of the silica sand, said foundry clay is present in an amount of from about 3 to about 5 percent by weight of the silica sand, said water is present in an amount of from about 4.7 to about 6 percent by weight of the silica sand, said core oil is present in an amount of from about 1.4 to about 2 percent by weight of the silica sand, said release agent is present in an amount of from about 0.3 to about 0.5 percent by weight of the silica sand, and said silica flour is present in an amount of from about 8 to about 12 percent by weight of the silica sand.

6. The foundry facing green sand composition of claim 5 wherein said cellulose binder is corn flour, wood flour, or wheat hulls, the foundry clay is bentonite or fireclay, and the release agent is kerosene.

7. A green sand foundry mold including as the metal-contacting mold surface, the facing sand composition of claim 1.

8. The green sand mold of claim 7 wherein said metalcontacting green sand mold surface is formed from the foundry facing green sand composition of claim 5.

* * * * *